United States Patent [19]

Nishida

[11] Patent Number: 4,634,392

[45] Date of Patent: Jan. 6, 1987

[54] PRESSURE RELIEF DEVICE FOR ENGINE ROOM OF A SMALL WATERCRAFT

[75] Inventor: Hiroshi Nishida, Miki, Japan

[73] Assignee: Kawasaki Jukogyo Kabushiki Kaisha, Kobe, Japan

[21] Appl. No.: 726,727

[22] Filed: Apr. 24, 1985

[30] Foreign Application Priority Data

Apr. 25, 1984 [JP] Japan ..... 59-60950[U]

[51] Int. Cl.[4] ..... B63H 21/36

[52] U.S. Cl. ..... 440/88; 114/270; 114/211

[58] Field of Search ..... 440/88, 89, 76, 77, 440/113; 114/335, 336, 337, 315, 212, 270, 211; 123/195 C, 198 E; 220/202, 203, 352, 356; 180/69.22; 137/467; 244/129.4

[56] References Cited

U.S. PATENT DOCUMENTS

| | | | |
|---|---|---|---|
| 2,670,755 | 3/1954 | Kendrick | 137/467 |
| 3,367,315 | 2/1968 | Whittle | 114/337 |
| 3,812,813 | 5/1974 | Dickson | 440/89 |
| 3,827,392 | 8/1974 | Jones | 114/270 |
| 4,518,363 | 5/1985 | Bland et al. | 114/212 |

*Primary Examiner*—Trygve M. Blix
*Assistant Examiner*—Edwin L. Swinehart

[57] ABSTRACT

A pressure relief device for an engine room of a small watercraft. The engine room is defined by an engine encasement, has an engine inside and is hermetically sealed with an engine cover. The pressure relief device has an opening provided in the engine encasement and a one-way valve which closes watertightly the opening through a grommet under normal conditions when the engine room pressure is below a given level of pressure, while it opens only outwards when the inside pressure goes up over the given level. It is desirable to employ a fastening member to secure the one-way valve on the opening in the engine encasement.

2 Claims, 2 Drawing Figures

PRESSURE RELIEF DEVICE FOR ENGINE ROOM OF A SMALL WATERCRAFT

BACKGROUND OF THE INVENTION

This invention relates to a pressure relief device for an engine room of a small watercraft which prevents the pressure in the engine room from exceeding a predetermined level of pressure by relieving the pressure inside.

The engine room, defined by an engine encasement, for small watercrafts is sealed with a cover on the opening of the engine encasement because small watercrafts, especially for sports, are apt to overturn at sea and take on water.

Since engine room space for such small watercrafts is relatively limited, if the engine encasement is hermetically sealed, the inside pressure will increase in case that a high temperature and high pressure exhaust gas leaks at engine-exhaust tube joints or the exhaust silencer fittings from vibrations produced by the engine, propeller and hull while sailing. If the engine cover is loosely fastened to the joints on the upper hull to relieve the increasing pressure, and the hull happens to be subjected to impacts due to the waves against the watercraft under sail, the shocks may cause the joints to work out of place, thus leading to the engine cover being flung away, or cause the watertightness between the engine cover and the upper hull to be poor, thus allowing the water to enter the engine room and rust the engine, resulting in troubles.

On the contrary, if said joints are tightly fastened to cope with the above mentioned troubles, this may generate such a high pressure in the engine room that the engine cover would be explosively removed by shocks from the waves or the like.

SUMMARY OF THE INVENTION

It can be said that the purpose and object of this invention is to provide a pressure relief device for an engine room of a small watercraft which eliminates said drawbacks of the prior art by employing a simple mechanism in order to ensure watertightness of the encasement under normal conditions as well as to relieve an increasing pressure inside the engine encasement once it is exceeding a preset level of pressure, thus preventing the engine cover from being flung away explosively.

To achieve aforesaid purpose, a pressure relief device according to the invention is employed, which comprises an opening provided in an engine encasement, and a one-way valve which closes watertightly the opening through a grommet under normal conditions when the engine room pressure is below a given level of pressure, while it opens outwards only when the inside pressure goes up beyond the given level. It is desirable to employ aforesaid fastening member to secure the one-way valve on the opening in the said engine encasement.

DETAILED DESCRIPTION OF THE PREFERRED EMBODIMENT

The following drawings depict in detail an embodiment according to the invention.

Figure 1:
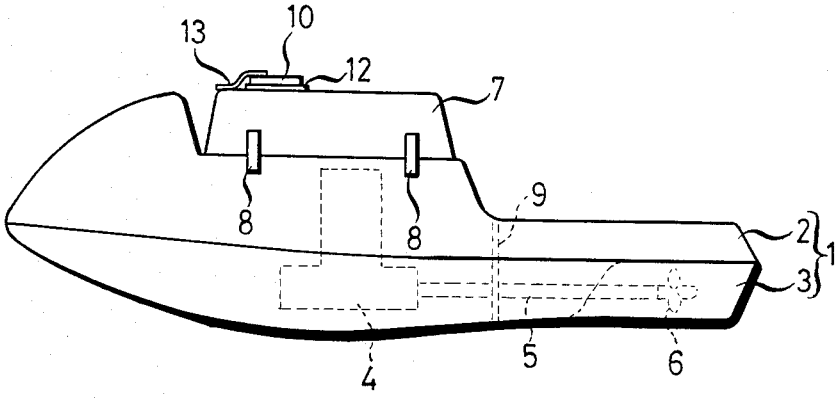
FIG. 1 is a schematic side view of an embodiment of a small watercraft equipped with a pressure relief device for an engine room according to the invention.

FIG. 1 is a schematic side view of an embodiment of a small watercraft equipped with a pressure relief device for an engine room according to the invention. In this drawing, numeral 1 is the hull of a watercraft consisting of the upper hull 2 and the lower hull 3, and the engine 4 is installed in said hull 1. The propeller 6 is driven by the propeller shaft 5 which is connected through a joint to the output shaft extending from the engine 4. An engine cover 7 is fastened to the upper hull 2 with fasteners 8 which firmly hold the engine cover 7 in place as well as assure watertightness between the upper hull 2 and the cover 7 to keep the water out of the engine encasement. Numeral 9 is the bulkhead.

Figure 2:
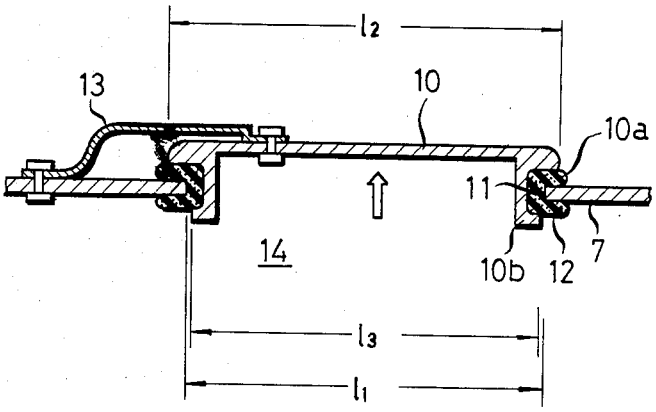
FIG. 2 is an enlarged sectional view of the pressure relief device.

A one-way valve 10 that constitutes the engine room pressure relief device according to the invention is mounted on the engine cover 7. FIG. 2 shows a detailed sectional view of the pressure relief device including the one-way valve.

The one-way valve 10 has two flanges 10*a* and 10*b* on the periphery. Symbols $l_1$, $l_2$ and $l_3$ denote respectively the inside diameter of the opening in the engine cover 7, the outside diameter of the flange 10*a* and the outside diameter of the flange 10*b*. There exists the following relationship between these diameters;

$$l_2 > l_1 > l_3$$

This relationship permits the one-way valve 10 to be pulled away from the opening only toward the outside of the engine encasement (as shown by an arrow in FIG. 2). Numeral 12 is a grommet made of a resilient material such as rubber which is placed between the engine cover 7 and the one-way valve 10 to prevent the water from entering the engine room.

The outer surface of the grommet 12 having a U-shaped cross section is fitted into the groove formed by the two flanges 10*a* and 10*b* on the one-way valve 10, while the inner surface is inserted into the periphery of the opening 11 in the engine cover 7. This construction does not allow the one-way valve 10 to come out of the opening 11 unless the pressure inside the engine encasement exceeds a predetermined level. A fastening piece 13 has two functions: Pressing the one-way valve 10 against the engine cover 7 in place, and preventing the one-way valve 10 from being flung away when the one-way valve 10 is disnegaged from the engine cover 7. Numeral 14 is the engine room.

The pressure relief device according to the invention having such a mechanism as stated above relieves the pressure, which accumulates inside the engine encasement from leaks of high pressure and high temperature exhaust gas, by lifting the one-way valve in the direction of the arrow in FIG. 2, when the pressure inside has reached the given level. On the contrary, up to the given pressure, the one-way valve 10 is never forced out of the opening 11 in the engine cover 7 and the needed watertightness is assured, since not only the one-way valve 10 is kept in position in the engine cover 7 by the fastening piece 13 which exerts a force on the one-way valve 10 against the engine cover 7 but also the grommet 12 of resilient material, as mentioned previously, is tightly inserted between the engine cover 7 and the one-way valve 10.

The relationship existing between the inner diameter of the opening 11 in the engine cover 7 and the outside diameters of the flanges 10*a* and 10*b*, i.e., $l_2 > l_1 > l_3$, prevents the one-way valve 10 from falling out of the opening 11 and into the engine room even when waves or other external forces act on the top of the one-way valve 10.

When the pressure in the engine room 14 goes up beyond the given level, an elastic deformation of the grommet 12 due to the pressure allows the one-way valve 10 to disengage out of the opening 11 in the engine cover 7 on account of the relationship $l_1 > l_3$ against the force on the top of the one-way valve by the fastening piece 13. This reduces the engine room pressure down to an atmospheric pressure. The one-way valve 10 disengaged from the engine cover 7 will not fly away because the one-way valve 10 is tied to the engine cover 7 through the fastening piece 13. The valve 10 can be put back in place with ease only by pushing the grommet 12 back into the opening 11 in the engine cover 7.

What is claimed is:

1. A sealing and pressure relief device for an engine room of a watercraft, the engine room having an encasement sealed except for an opening sufficiently wide to relieve excess pressure, said device comprising: a pressure relief member having a flange portion larger than said opening and located outside said encasement, another flange portion smaller than said opening and located inside said encasement, and a portion interconnecting said flange portions; and an annular resilient U-shaped grommet having two spaced leg portions respectively covering said encasement on opposite sides around said opening, and said U-shaped grommet also having a portion fit around said interconnecting portion and between said two flange portions, whereby said device seals said encasement against ingress of water, while excess pressure in said encasement can be vented by forcing said pressure relief member out of said opening.

2. A relief device according to claim 1, comprising means for attaching said member to said encasement.

* * * * *